US007385582B2

(12) United States Patent
Hudson

(10) Patent No.: US 7,385,582 B2
(45) Date of Patent: Jun. 10, 2008

(54) TEMPERATURE CONTROL AND COMPENSATION METHOD FOR MICRODISPLAY SYSTEMS

(76) Inventor: Edwin Lyle Hudson, 1290 Oakmead Pkwy., Suite 201, Sunnyvale, CA (US) 94085

( * ) Notice: Subject to any disclaimer, the term of this patent is extended or adjusted under 35 U.S.C. 154(b) by 260 days.

(21) Appl. No.: 10/645,988

(22) Filed: Aug. 22, 2003

(65) Prior Publication Data

US 2004/0036671 A1 Feb. 26, 2004

Related U.S. Application Data

(60) Provisional application No. 60/405,436, filed on Aug. 23, 2002.

(51) Int. Cl.
*G09G 3/36* (2006.01)

(52) U.S. Cl. ..... 345/101; 345/87; 345/98

(58) Field of Classification Search ..... 345/55–104
See application file for complete search history.

(56) References Cited

U.S. PATENT DOCUMENTS 3,936,817 A * 2/1976 Levy et al. ..... 345/214
5,926,162 A * 7/1999 Wood et al. ..... 345/101
5,936,603 A * 8/1999 Lippmann et al. ..... 345/101
RE37,056 E 2/2001 Wortel et al.
6,744,415 B2 * 6/2004 Waterman et al. ..... 345/87
6,806,871 B1 * 10/2004 Yasue ..... 345/211
6,930,667 B1 * 8/2005 Iijima et al. ..... 345/101

FOREIGN PATENT DOCUMENTS

WO PCT/US00/13063 8/2000

OTHER PUBLICATIONS

Authors: Slavko Amon, Danilo Vrtacnik, Drago Resnik, Dejan Krizaj, Uros Aljancic, Matej Mozek□□Title: PTAT Sensors Based on SJFETs□□10th Mediterranean Electrotechnical Conference, MEleCon 2000, vol. II□□pp. 802-805.*

* cited by examiner

*Primary Examiner*—David L. Lewis

(57) ABSTRACT

The present invention discloses the circuit configurations and control logic to monitor the temperature of the liquid crystal as directly as possible then render and pass this data to a processing unit. The control logic in the processor then issues corrections to the voltage delivered to the liquid crystal cell to permit the liquid crystal device to continue to operate in its useful voltage range (the monotonically increasing range previously mentioned.) The object is to provide temperature control and compensation control module that would be flexibly applicable to different types of microdisplay systems. For a microdisplay system where the E-O curve decreases monotonically with increasing voltage, the control module can issue an appropriate correction signal for controlling and compensating the performance of a microdisplay as temperature variation occurs. For particular microdisplay system wherein the liquid crystal does not behave monotonically, the control module of this invention can still be useful with special adaptations of curve fitting or database interpolation operations.

26 Claims, 6 Drawing Sheets

TEMPERATURE CONTROL AND COMPENSATION METHOD FOR MICRODISPLAY SYSTEMS

This application is a Continuation-in-Part (CIP) application and claim a Priority Date of Aug. 23, 2002 benefited from a Provisional Patent Application 60/405,436 file by one common inventor of this patent application.

BACKGROUND OF THE INVENTION

1. Field of the Invention

The present invention pertains to liquid crystal on silicon (LCOS) displays, and more particularly to improved temperature control and compensation method for the microdisplay systems.

2. Description of the Prior Art

Since microdisplay systems, especially the liquid crystal on silicon (LCOS) Microdisplay frequently operate in the hot interior of a projection device, the microdisplay technology is still challenged by the need to effectively control and compensate the performance variations caused by temperature increases such that the quality of display would not be impaired by uncontrolled high temperatures. There are several prior art approaches taken to solve this well-known problem. A first one was reported by Kurogane et al "*Reflective AMLCD for Projection Displays*"(D-LIA. Paper 5.3, Proceedings SID 1998) is the use of an electro-optic mode that does not exhibit noticeable thermal variation in the linear region of interest. However, the availability of the materials employed and special manufacture processes and mode of operations would significantly restrict the usefulness of the proposed microdisplay systems. Another is the approach taken in U.S. Pat. No. RE 37,056, Wortel, et al, "*Temperature Compensated Color LCD Projector*" (Feb. 20, 2001). where the inventors disclose a method to manufacture the cell in such a manner that the slopes of the electro-optic curves measured at different temperatures in the same liquid crystal device are quite close. A simple temperature measurement system is employed to provide information to a system that can adjust the column drive voltage and thus effect the compensation. However, this particular approach is of limited usefulness because the method requires a very specific approach to the design and manufacture of the cell.

In view of the current state of the art of microdisplay temperature control, there is an ever-increasing demand for new methods and system configurations that can effectively control the temperature and to compensate the performance variations caused by the temperature changes due to the temperature sensitivities of the microdisplay systems. There are several reasons for such increased demand. First, it is observed from operations of microdisplay systems that a liquid crystal experiences a rise in temperature from ambient over a period of 20 to 30 minutes after a system is turned on. This rise in temperature is attributable in part to a rise in ambient temperature within the product case due to heating of the air within by such items as the lamp and by other electronic components. A second major source of heating is the heat generated from the thermal characteristics of the silicon in the LCOS microdisplay itself. A third major source is heat caused by the illumination from the lamp falling on the microdisplay itself. The degree of temperature increase depends on the thermal design of the product and the environment in which it operates. A second reason for the increasing demand to control and compensate temperature effect for a microdisplay system is an observation that the system performance of a microdisplay is strongly temperature dependent. A first sensitivity of LCOS microdisplays is the reduction of the birefringence of the liquid crystal material with elevated temperature within such a display with thus the electro-optic (EO) curve for such a device is highly temperature dependent. One particular aspect of this temperature driven effect is that the dark state rises as temperature deviates from the design temperature and therefore the contrast of such a system suffers.

FIG. 1A shows the strong influence of the temperature changes on the electro-optic performance of a nematic liquid crystal cell constructed by using a 45° twisted nematic (45° TN) in normally black (NB) electro-optic mode. The cell is nominally 5.5 μm thick. The clearing temperature of the liquid crystal is not precisely known but is estimated to be 85° C. Four sample temperature curves determined by experiment are depicted. Thus the major effects of the temperature variations are clear upon inspection. First, the liquid crystal (LC) curve shifts to lower voltage as the temperature of the LC rises. Second, the intensity of the achievable dark state rises as temperature rises. The apparent magnitude of the dark state intensity appears to increase nonlinearly as temperature rises. Third, the location of the peak of the voltage curves shifts to lower voltages as the temperature rises. Fourth, the height of the peak of the voltage curve drops slightly as temperature rises. Finally, the voltage required to achieve the best dark state does not appear to move significantly with changes in temperature.

Referring to the LC curves of FIGS. 1B and 1C disclosed in U.S. Pat. No. RE 37,056 for further understanding of the temperature dependence of the performance of a microdisplay system. FIG. 1B shows diagrammatically transmission/voltage characteristics of a display device according to the invention at different temperatures, while FIG. 1C shows similar characteristics for a conventional display device. The data as illustrated in FIGS. 1B and 1C are curves for normally white mode transmissive displays which are also representative of reflective mode normally white displays as well. As disclosed in the patent, FIG. 1B presents data that is better behaved than that of FIG. 1C. Implicit in the patent itself in describing the difficulty is the likelihood that the liquid crystal cell is being driven by an analog drive source, such as a Digital-to-Analog Converter (DAC). The DAC would have to be adjusted to a completely different slope and origin in configuring it to drive at different temperature in the case of FIG. 1C. The control and compensation of temperature variation for microdisplay system according to the disclosed techniques would become more cumbersome and inconvenient due to this adjustment requirement.

Thus from the above it is clear that temperature is an important factor in the performance of a liquid crystal device. It is also clear that knowledge of the temperature of a liquid crystal device can enable several commonly known control mechanisms in the electro-optical-mechanical design of a product using such devices. In order to control the microdisplay operational temperature, traditional measures includes the use of fan controlled by a thermostat for activating a fan to increase the air circulation of a microdisplay system. Alternatively the thermostat may be position to measure the heat at a set of heat sinks mounted to the back of the microdisplays. Additionally, the knowledge of several control mechanisms in the electro-optical-mechanical design embodied in different products using such mechanisms can be implemented to further exploit such knowledge to achieve optimal performance. However, as of now, the conventional technologies in microdisplay temperature control still have not fully take advantage of the availability of different control mechanisms to improve and enhance the temperature control and compensation for microdisplay systems operated under widely varying temperatures.

For these reasons, there is still need in the art of microdisplay such as the liquid crystal on silicon (LCOS) display to provide improved system architecture and methods of temperature control and compensation to improve the system performance under wide ranges of temperature variations such that the above-mentioned limitations and difficulties can be overcome.

SUMMARY OF THE PRESENT INVENTION

It is therefore an object of the present invention to provide new and improved circuit configurations and control logic to monitor the temperature of the liquid crystal as directly as possible, render and pass this data to a processing unit. The control logic in the processor then issues corrections to the voltage delivered to the liquid crystal cell to permit the liquid crystal device to continue to operate in its useful voltage range (the monotonically increasing range previously mentioned.) The object is to provide temperature control and compensation control module that would be flexibly applicable to different types of microdisplay systems. For example, for a microdisplay system where the E-O curve decreases monotonically with increasing voltage, the control module can issue an appropriate correction signal for controlling and compensating the performance of a microdisplay as temperature variation occurs. For particular microdisplay system wherein the liquid crystal does not behave monotonically, the control module of this invention can still be useful although special adaptations would need to be made. For example, for a microdisplay system operated with a normal white mode, special adaptation by employing the control functions as that shown in FIGS. 1B and 1C disclosed by U.S. Pat. No. RE 37,056, can be incorporated.

These and other objects and advantages of the present invention will no doubt become obvious to those of ordinary skill in the art after having read the following detailed description of the preferred embodiment, which is illustrated in the various drawing figures.

DETAILED DESCRIPTION OF THE PREFERRED EMBODIMENT

Figure 2:
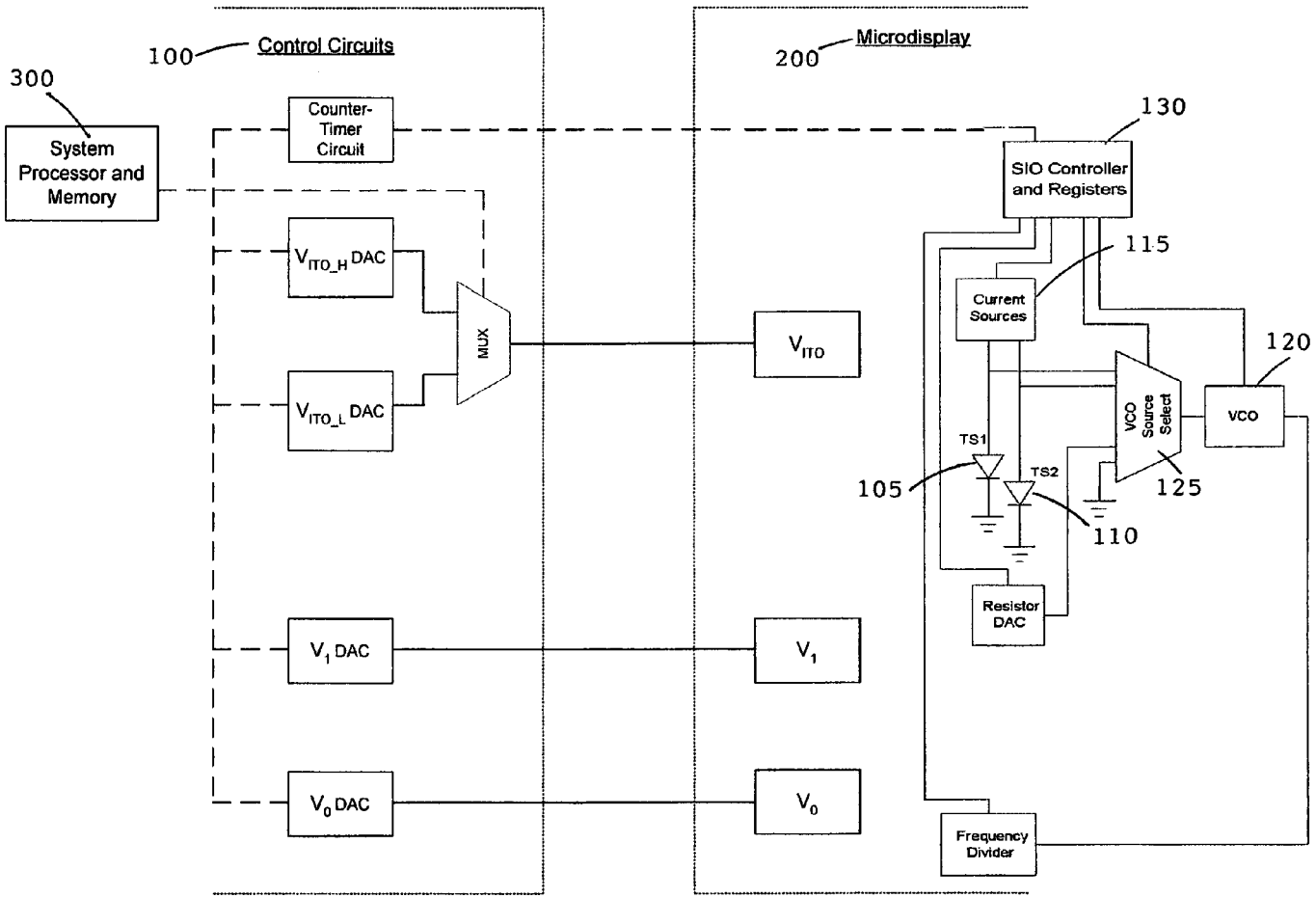
FIG. 2 is a functional block diagram for showing the interfaces between the microdisplay controller of this invention and the temperature sensor for controlling the microdisplay temperature.

Referring to FIG. 2 for the basic interfaces between the microdisplay controller 100 and the microdisplay device 200. The signals of temperature measurements are provided to the controller 100 from the temperature sensor shown as TS1 105 and TS2 110. In another co-pending patent application Ser. No. 10/627,230 submitted by the Applicant of this Application, the details of the temperature measurement system are described. The patent application Ser. No. 10/627,230 is hereby incorporated as reference in this Application. In a preferred embodiment of the temperature sensing system as disclosed in the co-pending Application includes two diodes of two unequal current drains as shown as TS1 and TS2. The currents passed from the current source 115 through the two temperature sensing diodes TS1 105 and TS2 110 are applied to a voltage controlled oscillator VCO 120 via a VCO source selecting device 125 to generate an output signal as frequency that dependent on the temperature measurements. The temperature sensors are integrated into a backplane of a microdisplay system such that the sensors are disposed immediately next to the liquid crystal material where the temperature measurements and control are most crucial by controlling the temperature for improving the quality of image display.

For better understanding of this invention, another co-pending application Ser. No. 10/329,645 submitted by a co-inventor of this patent application is also incorporated herein as reference. The co-pending patent application Ser. No. 10/329,645 discloses a microdisplay controller and the microdisplay design that deliver voltages to the pixels based on a pulse width modulation scheme. Each pixel circuit has two voltage supplies deliverable to it, termed $V_0$ and $V_1$ that correspond to dark state and light state voltages. The voltages are relatively fixed and do not vary with data. A new data load modulates the display when this new data load overwrites the previous data load. The pixel switches to the other supply when the data on the pixel is changed. To DC balance the liquid crystal associated with the pixel electrode, a multiplex signal is sent to each pixel that switches a pixels voltage selection to the other supply and simultaneously switches the counter electrode to a new value that mains the symmetric nature of the liquid crystal drive voltage. The DC balancing of the display need not be accomplished synchronously with the switching of data. The modulation of the liquid crystal occurs because the pixels of the microdisplay switch between the two voltage supplies at a sufficiently rapid rate so as to appear as a voltage waveform. When this switching speed takes place at a very fast rate, the liquid crystal will appear to be responding to the RMS of the waveform. Thus switching between two voltages—one at or near the peak of the "white" region and the other at the "black" point, the liquid crystal will respond as if driven by a switching DC waveform at some intermediate point between the two voltages. The RMS voltage over the time scale of the liquid crystal reaction determines the exact point of reflectivity and that is the points to which the liquid crystal device is driven.

In the case of the normally black mode previously described, it is possible to present the curves in a different manner. Rather than display voltage versus throughput, the classic voltage-transfer curve, it is possible to plot a "digital drive-transfer" curve where the throughput is plotted as a function of the digital word that is used to create the drive voltage in the scheme under consideration. The digital word corresponds to a gray level in the drive scheme. Gray levels may range from 2 (full on or full off) to as many as are practical. In modern color display systems gray levels may vary from 6 bits per color in some inexpensive flat panel displays to as high as 12 or 14 bits per color (36 to 42 bits) in some very expensive high end displays.

Referring to FIG. 2 again, for a particular configuration that the microdisplay controller 200 function as an interface to the system microprocessor 300. The temperature is measured onboard the silicon die of a microdisplay and the temperature sensing circuit 120 converts the temperature into square waves representing a frequency or period signal. The signals are transmitted over the interconnections; typically parallel flex cable for inputting to microdisplay controller 200 by first converting through a counter timer circuit 130 to a digital word. The digital word is then posted on the Control Register 130 where the microprocessor 300 can poll and readout the frequency data corresponding to a temperature measurement signal. The Microprocessor 300 takes the data presented and performs several analyses upon it. The microprocessor 300 can first assess the data for reasonability based on previous data. If the data is reasonable it then calculate the new $V_0$ and $V_1$ for the display based on interpolation within a lookup table characterizing the $V_0$ and $V_1$ at specific temperatures for the microdisplay. In FIG. 2 the solid lines represent a physical electric connection and the dashed lines represent flow of control signals and data. All lines form the system processor and memory is logic control lines.

The output of the temperature sensor transmitted back to the counter-timer circuit 140 contains data available for to be further processed by the system processor 300. The counter time circuit 140 on the Control Circuits 100 is optional in that it is needed for circuits of a specific implementation. Alternatively, if the temperature sensor output were an analog voltage then the device could be replaced by an Analog to Digital converter (ADC). If the output were digital, then the block could be dispensed with and the output could be fed directly to the System Processor and Memory. The System Processor and Memory 300 loads digital words into the $V_{ITO_H}$ DAC and $V_{ITO_L}$ DAC that correspond to voltages that the DACs are to generate. The outputs of these DACs are fed into a multiplexer MUX that selects which DAC voltage is to be used to drive the ITO voltage ($V_{ITO}$). The DACs are preferentially Resistor DACs because RDACs have superior accuracy after calibration. Alternatively they can be laser-trimmed DACs of any sort. The DAC voltage may pass through OpAmps (not depicted) to scale their voltages if the required voltage is not within the direct voltage range of the DAC. Furthermore, the System Processor Memory 300 loads digital words into the $V_1$ DAC and $V_0$ DAC that correspond to voltages that the DACs are to generate. The outputs are fed directly into the microdisplay ports for $V_0$ and $V_1$. The DACs are preferentially Resistor DACs because RDACs have superior accuracy after calibration. Alternatively they can be laser-trimmed DACs of any sort. The DAC voltage may pass through OpAmps (not depicted) to scale their voltages if the required voltage is not within the direct voltage range of the DAC.

Figure 3A:
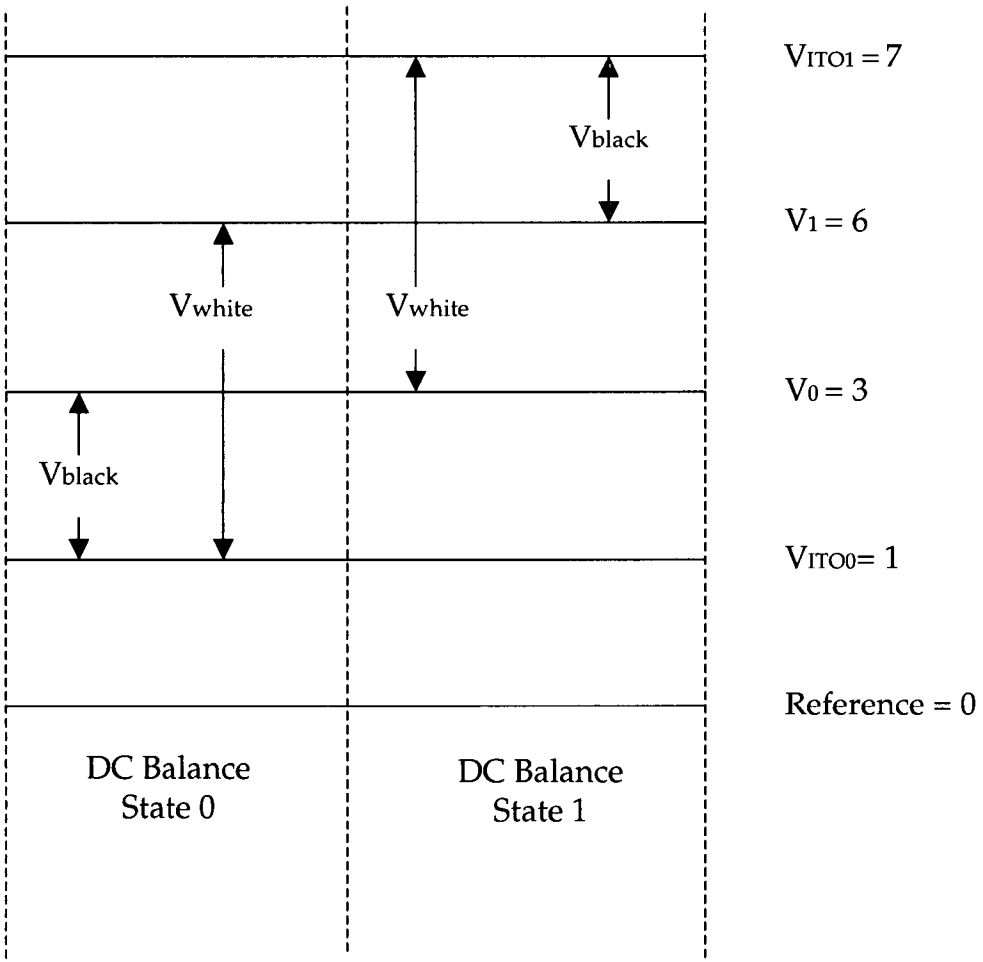
FIGS. 3A and 3B show the reference voltage level for DC balancing of a liquid crystal display system and the variation of drive voltage due to temperature changes.
Figure 3B:
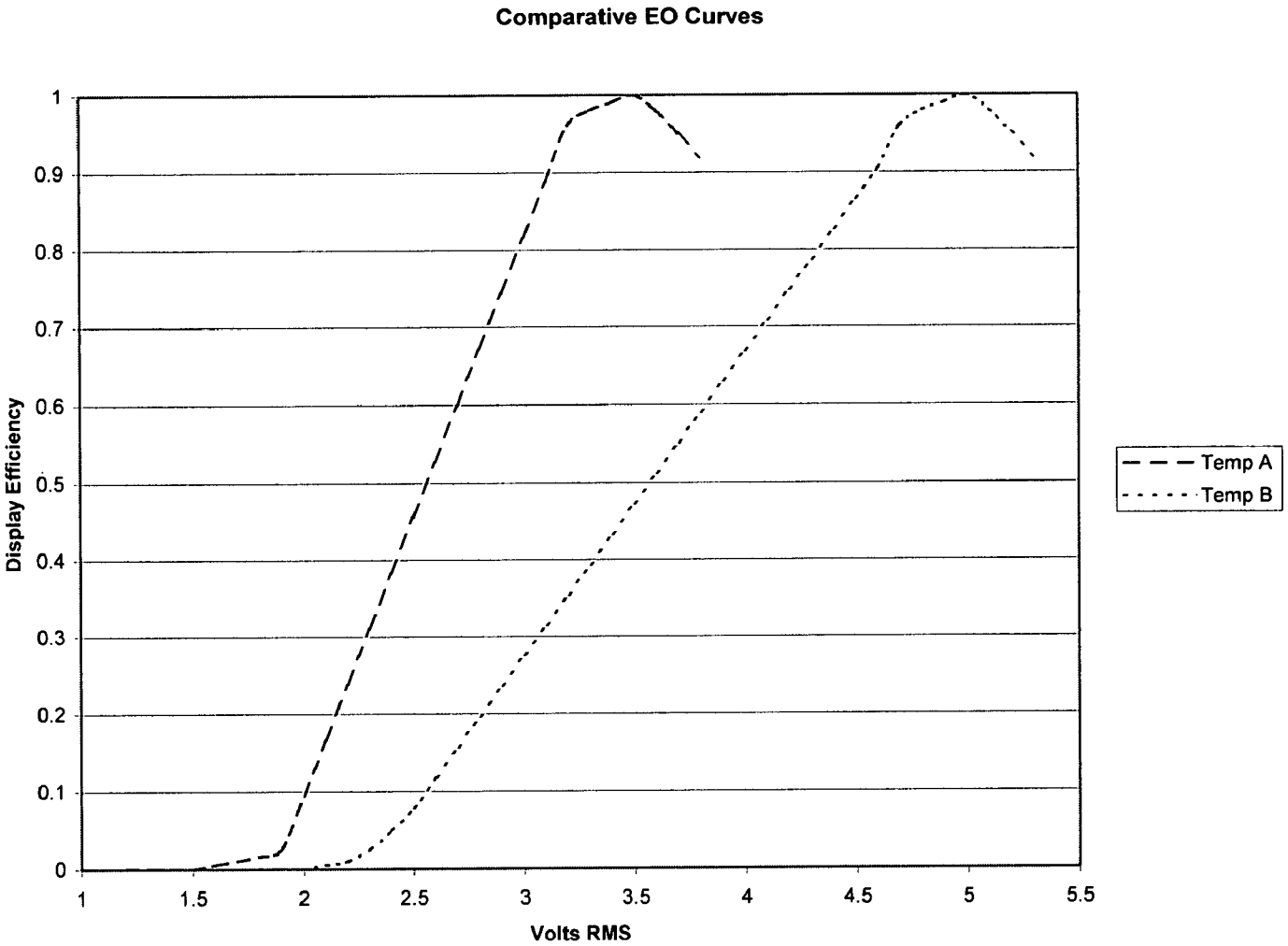
Figure 3C:
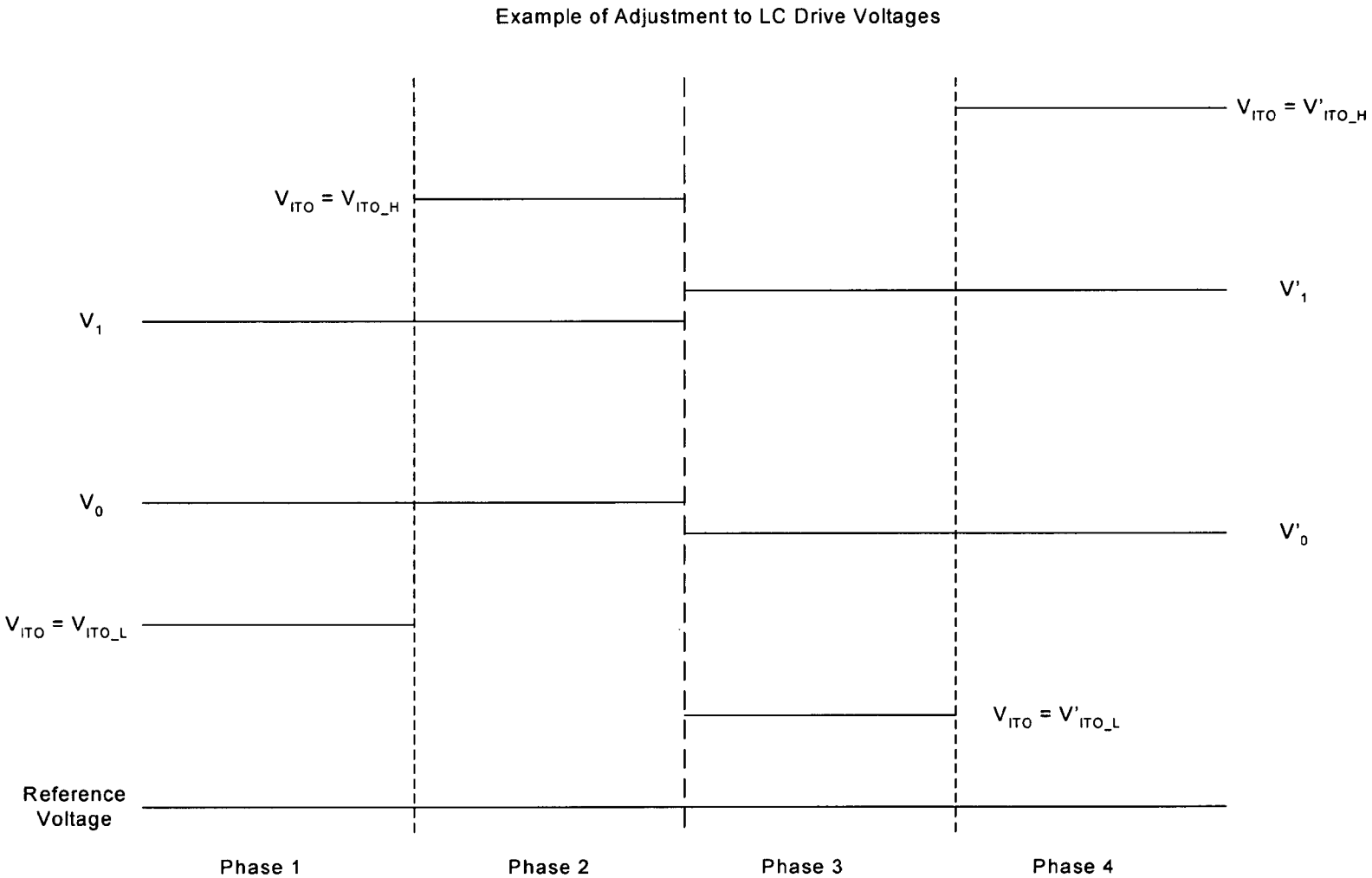
FIG. 3C is diagram showing an example of voltage level changes at different phase of operation of a microdisplay having different temperatures.

There is a normal relationship between the various voltages referenced as that shown in FIG. 3A. The absolute magnitude of the difference between $V_0$ and $V_{ITO_L}$ is equal to the absolute magnitude of the difference between $V_1$ and $V_{ITO_H}$. The relationship of the various voltages insures that the liquid crystal cell remains accurately DC balanced during operation. With the relationship between different voltages as shown, the control system of the present invention for the microdisplay makes use of measured temperatures to adjust the voltage operating parameters to optimize performance of the liquid crystal device. Referring to FIG. 3B as an example that illustrates the electro-optical (EO) curve changes with temperature. One represents the electro-optic curve for Temperature A where the curve is steep and the difference between the white state voltage and the dark state voltage is around 2.0 volts. The other represents the electro-optic curve for Temperature B where the curve is less steep and the difference between the white state voltage and the dark state voltage is around 3.0 volts. The voltage shift as shown is probably unusual and is provided for illustrating the fact that as the temperature changes the optimal drive voltages will also change. The present invention provides control mechanism to effectively respond to such variations. As the results of variations of drive voltages at different temperatures, the system processor 300 can carry out selection of optimal voltages in different ways. The microprocessor takes into consideration the fact that the modification of voltage operating point in response to changes in temperature is likely to take place relatively slowly—on the time scale of seconds rather than milliseconds. Each microdisplay has a different thermal environment. Blue, for example, normally runs hotter because blue light has more energy than green or red. Also mounting considerations may make one microdisplay hotter than others because of proximity to the lamp. (A bad design practice but also very common.) Therefore each microdisplay should be managed separately. Special data can be loaded into the database of the microprocessor 300 to provide microdisplay dependent control base on special operational characteristics of the microdisplay. The data for each microdisplay system can be collected and then stored in a lookup table for later use. The use of interpolation within the lookup table to resolve to more optimal solutions may be required. As the voltages are modified, it is essential that the relationship between voltages described above be maintained to maintain DC balance of the liquid crystal cell. This requires some form of calibration, as previously mentioned. The system processor can be programmed to carry out different calibration operations and data interpolations to determine the optimal voltages at a different temperature as that shown in FIG. 3C to achieve optimal image display quality when temperature variations occur.

In another embodiment, the system may use a combination of system control measures, such as manipulation of device fans and the like, to keep the microdisplay temperature within a relaxed but manageable range while manipulating the microdisplay voltage range to permit fine control over the performance of the liquid crystal. With the use the microprocessor instead of just a microdisplay controller, a microprocessor of the present invention can control three microdisplay controllers so that the microprocessor can monitor and control all three microdisplay controllers and decide proper responses under three different varying temperatures. Alternatively each microdisplay controller may control autonomous response to these environmental factors, such responses including items such as individual fans and the like.

The temperature control method as disclosed in this invention is implemented with signal transmission and processing over a number of system components. A more complete and accurate temperature control configuration and method are disclosed in this invention to effectively monitor and control the temperature to assure image quality of microdisplay are optimally monitored and adjusted with accurate measurements. As described above, the microdisplay controller 100 provides an interface to the system microprocessor unit 300 by inputting the temperature measurement signals. Note that the control functions described for a separate microprocessor unit 300 could actually be designed into a processing section within the microdisplay controller unit 100. In the instance where several microdisplays and microdisplay controllers are in use simultaneously in the same unit, it may be preferable architecturally to make the microprocessor 300 separate physically or logically. The primary requirement is to establish a means to transfer temperature data from the microdisplay controller 100 to the microprocessor 300 and to receive instructions from the microprocessor unit 300 to the microdisplay 200. In this instance the data to be moved is first placed in the microdisplay controller Control Register 130 and then is picked up by microprocessor 300 through the microprocessor port.

The microprocessor unit 300 may optionally be programmed to assess the reasonability of an individual temperature word received from the microdisplay. Such tests result from an abundance of caution. The microprocessor may perform a trend analysis. Alternatively the device may inspect for a maximum temperature shift. Depending on specific applications, more or less sophisticated analysis techniques can be applied.

The invention according to the present patent application could make use of cells constructed in either fashion for a normally black mode or a normally white mode liquid crystal device. Normally black mode is nearly dark in the relaxed state and is driven to a brighter state while the normally white mode is at a bright state in the relaxed state and must be driven to a black state. The voltage control in response to temperature changes as disclosed in this invention can obviously work for either types of devices. This is because the interpolation between the bright state and the dark state is accomplished by varying the RMS value according to the method described below. The DAC would have to be adjusted to a completely different slope and origin in configuring it to drive at different temperature. While the approach described below would vary RMS by moving between the light state voltage and the dark state voltage by use of pulse width modulation.

The use of fan controlled by a thermostat for activating a fan to increase the air circulation of a microdisplay system. Alternatively the thermostat may be position to measure the heat at a set of heat sinks mounted to the back of the microdisplays. Such control measures are compatible with the present invention and the prior art can be combined with the present invention as an optional to implement in one of several alternate preferred embodiments.

As disclosed in the co-pending application Ser. No. 10/627,230, an improved temperature measurement circuit implemented in the silicon design of a liquid crystal on silicon microdisplay where other less robust approaches are used, such as a single diode or pair of diodes, to provide means to make such measurements. Alternatively, an external temperature measurement device such as a thermistor or an RTD (resistive temperature detector) can be placed external to the device in a position that permits estimation of the liquid crystal state from the environmental temperature. The configuration of this invention may also be implemented in a microdisplay system that has a steady state situation where the relationship between the liquid crystal temperature and the temperature measured by a sensor at the back of the display may remain static. However, as many microdisplay systems, particularly those implemented with liquid crystal display may operate with temperature fluctuations that an external temperature measurements may not provide sufficient accuracy to assure good image quality can be maintained when the temperature fluctuates.

According to above descriptions, this invention discloses a microdisplay system that includes a thermal control and management system. The thermal control and management system has a voltage database for receiving and processing a microdisplay temperature measurement signal for the microdisplay system by employing the voltage database to generate a temperature-dependent reference voltages for operating the microdisplay system most suitable for the temperature measurement signal. In a preferred embodiment, the thermal control and management system further includes a data processing means for generating a temperature-dependent black state voltage and a white state voltage as the temperature-dependent reference voltages for operating the microdisplay system most suitable for the temperature measurement signal. In another preferred embodiment, the data processing means further includes control register for loading and reading the temperature measurement signal. In another preferred embodiment, the data processing means further includes DAC output circuits for outputting the temperature dependent reference voltages. In another preferred embodiment, the data processing means further includes an interpolation means for interpolating between two data in the database for generating the temperature dependent reference voltages. In another preferred embodiment, the microdisplay system further includes a temperature sensor system that has a temperature senor embedded in the microdisplay.

Figure 1A:
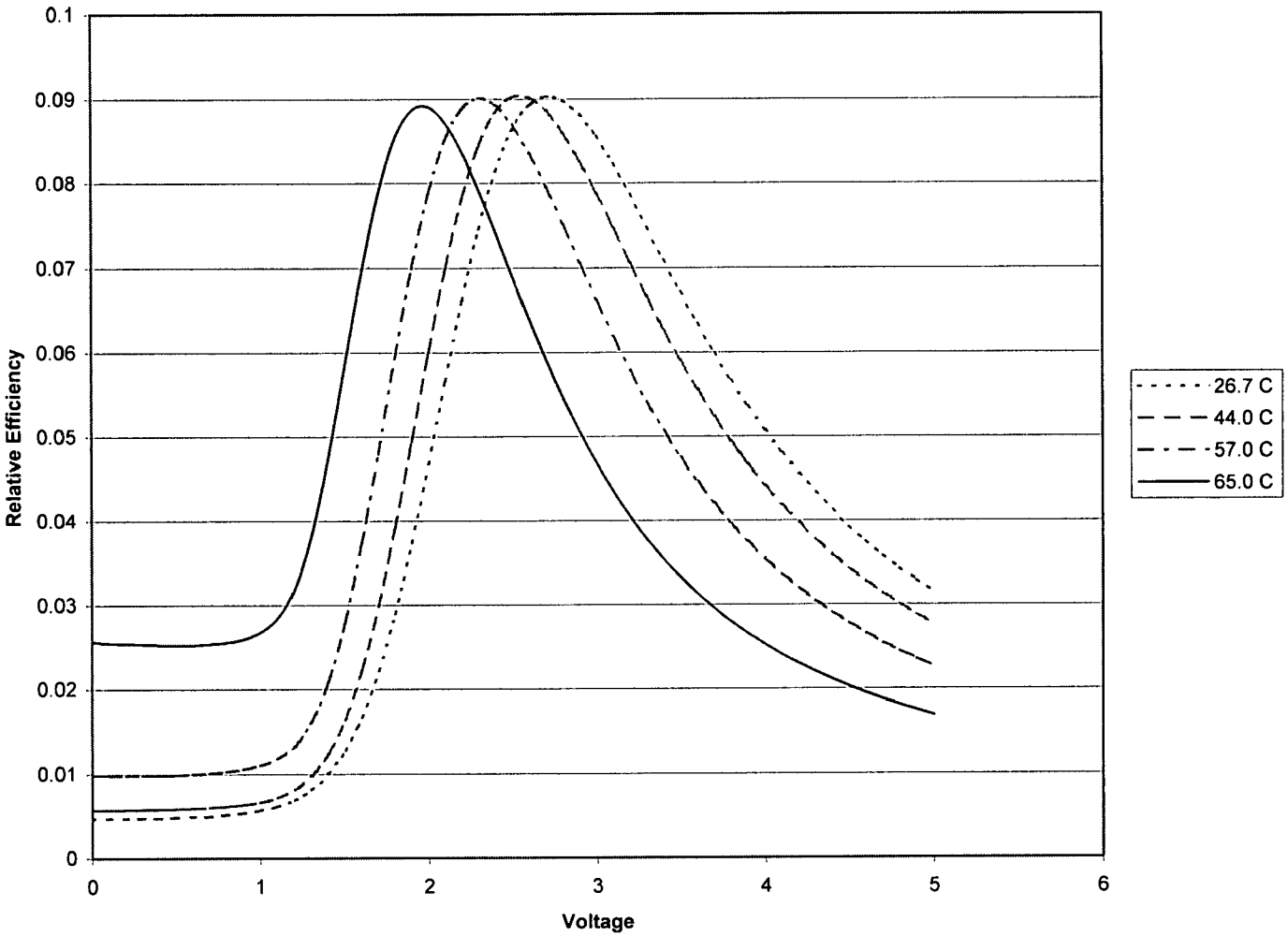
FIG. 1A is a diagram for showing the variations of the electro-optic performance of nematic liquid crystal versus the variations of temperature.
Figure 1B:
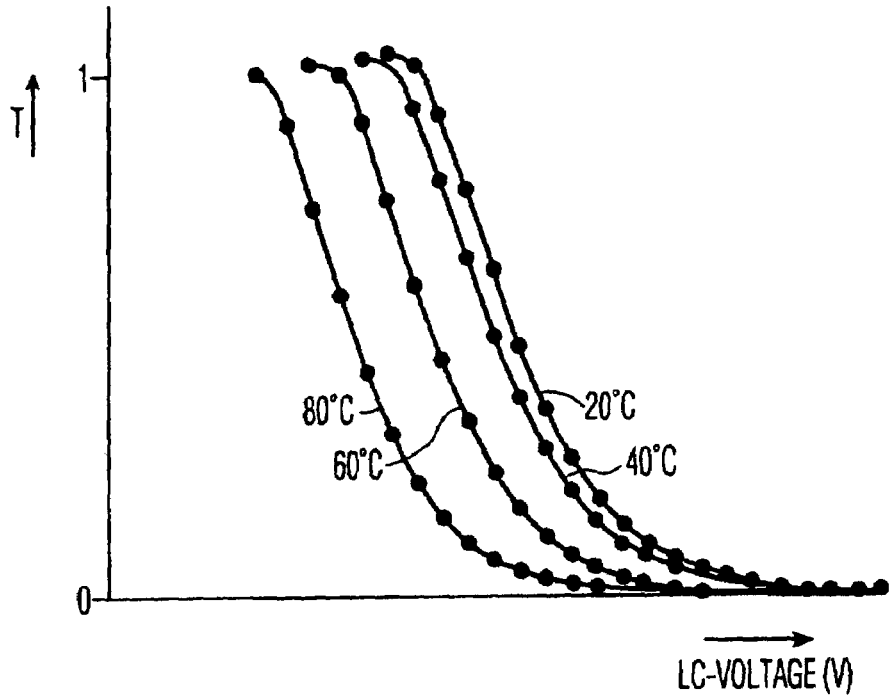
Fig. 1B (Prior Art)
FIG. 1B is a diagram for showing the transmission/voltage characteristics of a display device at different temperatures disclosed in another US patent.
Figure 1C:
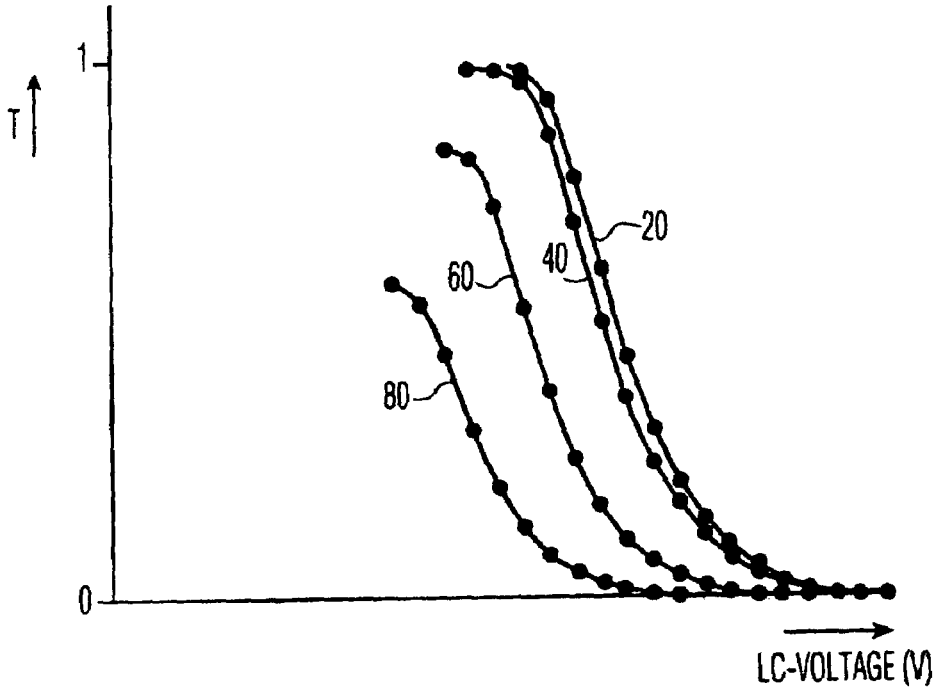
Fig. 1C (Prior Art)
FIG. 1C shows similar characteristics as FIG. 1B for another conventional display device.

Furthermore, this invention discloses a method for temperature control and compensation for a microdisplay system. The method includes a step of receiving and processing a microdisplay temperature measurement signal from the microdisplay system by employing a voltage database to generate a temperature-dependent reference voltages for operating the microdisplay system most suitable for the temperature measurement signal. In another preferred embodiment, the step of generating the temperature-dependent reference voltages further comprising a step of generating a temperature-dependent black state voltage and a white state voltage for operating the microdisplay system most suitable for the temperature measurement signal. In another preferred embodiment, the step of receiving and processing the temperature measurement signal from the microdisplay further includes a step of receiving the temperature measurement signal into a data processing means having a control register for loading and reading the temperature measurement signal. In another preferred embodiment, the step of generating the temperature-dependent reference voltages for operating the microdisplay system further includes a step of outputting the temperature-dependent reference voltages through DAC output circuits. In another preferred embodiment, the step employing the voltage database for generating the temperature-dependent reference voltages further comprising a step of interpolating between two data in the database for generating the temperature dependent reference voltages, in a specific embodiment, the interpolation may be performed based on a curve-fitting algorithm to best fit an E-O curve such as that shown in FIGS. 1B and 1C. In another preferred embodiment, the method further includes a step of employing a temperature sensor system having a temperature senor embedded in the microdisplay.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

The invention claimed is:

1. A liquid crystal display (LCD) system implemented with a thermal control and management system comprising a temperature sensor system disposed directly on a backplane of a silicon die of a LCD microdisplay device immediately next to a liquid crystal material for directly measuring a temperature of said microdisplay device and generating a frequency output by a voltage control oscillator (VCO) as a temperature measurement signal;

a microdisplay controller for controlling voltages of said microdisplay device and receiving said temperature signal for transmitting a digital signal to a system processor; and said system processor processing said digital signal corresponding to said temperature of said microdisplay device to generate temperature-dependent reference signals for inputting to a said microdisplay controller for controlling said voltages of said microdisplay device in response to said temperature measurement signal.

2. The LCD system of claim 1 wherein:

said system processor inputting said temperature dependent reference signals into a multiplexer of said microdisplay controller for generating a temperature-dependent black state voltage and a temperature-dependent white state voltage applied to a common electrode connected to a plurality of pixel cells for controlling said voltages of said microdisplay device in response to said temperature measurement signal.

3. The LCD system of claim 1 wherein:

said microdisplay controller further includes a control register for loading and reading said temperature measurement signal as a digital word.

4. The LCD system of claim 3 wherein:

said microdisplay controller further includes a digital-to-analog converter (DAC) for converting said frequency output as said temperature measurement signal received from said temperature sensor system as temperature dependent voltages.

5. The LCD system of claim 1 wherein:

said system processor further interpolating between two data in a database for generating said temperature dependent reference signals for inputting to said microdisplay controller.

6. The LCD system of claim 1 wherein:

said temperature sensor system further integrated as an integrated circuit (IC) chip disposed directly on said backplane of a silicon die immediately next to a liquid crystal material of said LCD microdisplay device.

7. The LCD system of claim 1 wherein:

said temperature sensor system further comprising a PTAT temperature sensor system and integrated as an IC chip disposed directly on said backplane of a said silicon die immediately next to said liquid crystal material of said LCD microdisplay device for generating a frequency output by a voltage control oscillator (VCO) as a temperature measurement signal.

8. The LCD system of claim 1 wherein:

said system processor further includes an additional cooling activating system to activate additional cooling for said LCD microdisplay device in response to said temperature measurement signal.

9. The LCD system of claim 1 wherein:

said system processor further determining if said temperature measurement signal is within a predefined range.

10. The LCD system of claim 1 wherein:

said system processor further receiving and processing said temperature measurement signal to function as a part of a Peltier thermal control loop.

11. The LCD system of claim 1 wherein:

said microdisplay controller controlling said voltages of said microdisplay device in response to said temperature measurement signal for operating said LCD microdisplay device as a liquid crystal display device of a normally white mode device.

12. The LCD system of claim 1 wherein:

said microdisplay controller controlling said voltages of said microdisplay device in response to said temperature measurement signal for operating said LCD microdisplay device as a liquid crystal display device of a normally black mode device.

13. The LCD system of claim 4 wherein:

said DAC further comprising a resistor digital to analog converter (RDAC).

14. A liquid crystal display (LCD) system comprising:

a thermal control and management system having a voltage database for receiving and processing a microdisplay temperature measurement signal for said LCD system by employing said voltage database to generate a temperature-dependent reference voltage for inputting to multiplexer of a microdisplay controller for controlling a high and a low voltages of a common electrode for controlling a high and low voltages of a liquid crystal panel supporting a plurality of pixel cells switchable for a DC balancing of said LCD display system whereby higher speed of DC balancing switch of said LCD system can be accomplished.

15. The liquid crystal display (LCD) system of claim 14 wherein:

said microdisplay controller further generating a temperature-dependent black state voltage and a white state voltage as said switchable temperature-dependent reference voltages of said liquid crystal panel in response to said temperature measurement signal for DC balancing said LCD display system.

16. The liquid crystal display (LCD) system of claim 15 wherein:

said microdisplay controller further includes a control register for loading and reading said temperature measurement signal.

17. The liquid crystal display (LCD) system of claim 15 wherein:

said system processor further includes DAC output circuits for outputting said temperature dependent reference voltages.

18. The liquid crystal display (LCD) system of claim 15 wherein:

said system processor further interpolating between two data in said database for generating said temperature dependent reference voltages.

19. The liquid crystal display (LCD) system of claim 14 further comprising:

said temperature sensor system is further integrated as an integrated circuit chip disposed directly on a backplane of a silicon die of a LCD microdisplay device immediately next to a liquid crystal material in said LCD system for generating a frequency output by a voltage control oscillator (VCO) as a temperature measurement signal.

20. A method for temperature control and compensation for a microdisplay system comprising:

receiving and processing a microdisplay temperature measurement signal from said microdisplay system by employing a voltage database to generate a temperature-dependent reference high and low voltages; and inputting said temperature-dependent high and low reference voltages into a multiplexer of a microdisplay DC-balancing controller for controlling voltages of common electrodes connected to a liquid crystal panel supporting a plurality of pixel cells of said microdisplay system in response to said temperature measurement signal for DC balancing said LCD system.

21. The method of claim 20 further comprising:

said step of generating said temperature-dependent high and low reference voltages further comprising a step of multiplexing and generating a temperature-dependent black state voltage and a white state voltage according to a DC balancing state for controlling voltages of said common electrodes connected to said liquid crystal panel supporting said plurality of pixel cells of said microdisplay system in response to said temperature measurement signal for DC balancing said LCD system.

22. The method of claim 20 wherein:

said step of receiving and processing said temperature measurement signal from said microdisplay further includes a step of receiving said temperature measurement signal into a system processor having a control register for loading and reading said temperature measurement signal.

23. The method of claim 20 wherein:

said step of generating said temperature-dependent reference voltages further comprising a step of outputting said temperature-dependent reference voltages through DAC output circuits to said multiplexer.

24. The method of claim 20 wherein:

said step employing said voltage database for generating said temperature-dependent reference voltages further comprising a step of applying said temperature measurement signal for interpolating between two data in said database for generating said temperature dependent reference voltages.

25. The method of claim 20 further comprising:

employing a temperature sensor system integrated as an integrated circuit chip disposed directly on a backplane of a silicon die immediately next to a liquid crystal material of a LCD microdisplay device of said microdisplay system for generating a frequency output by a voltage control oscillator (VCO) as a temperature measurement signal.

26. The method of claim 20 wherein:

said step employing said voltage database for generating said temperature-dependent reference voltages further comprising a step of applying said temperature measurement signal for carrying out a curve-fitting algorithm using data in said database for generating said temperature dependent reference voltages to said common electrodes connected to said liquid crystal panel supporting said plurality of pixel cells of said LCD system.

* * * * *